US005538342A

United States Patent [19]

Aoshima

[11] Patent Number: 5,538,342

[45] Date of Patent: Jul. 23, 1996

[54] METHOD AND APPARATUS FOR STIRRING FLUID

[75] Inventor: Masuo Aoshima, Shizuoka, Japan

[73] Assignee: Aoshima Jjdosha Co., Ltd., Shizuoka, Japan

[21] Appl. No.: 503,086

[22] Filed: Jul. 17, 1995

[30] Foreign Application Priority Data

Jan. 13, 1995 [JP] Japan ..... 7-003640

[51] Int. Cl.[6] ..... B01F 7/22

[52] U.S. Cl. ..... 366/279; 366/297; 366/326.1

[58] Field of Search ..... 366/279, 326.1, 366/327.1, 329.1, 329.2, 330.1, 330.2, 331, 327.4, 297, 298, 299, 300

[56] References Cited

U.S. PATENT DOCUMENTS

| | | | |
|---|---|---|---|
| 2,448,927 | 9/1948 | Fischer | 366/326.1 |
| 2,799,485 | 7/1957 | Silverman | 366/329.1 |
| 3,606,260 | 9/1971 | Rubin | 366/330.1 |
| 4,256,406 | 3/1981 | Somerville | 366/279 |
| 5,046,856 | 9/1991 | McIntire | 366/297 |
| 5,211,924 | 5/1993 | Lee | 366/279 |

*Primary Examiner*—Robert W. Jenkins
*Attorney, Agent, or Firm*—Kanesaka & Takeuchi

[57] ABSTRACT

In an apparatus and a method of the invention, a large amount of fluid is processed in a short time, and it is possible to use even in a square tank without losing certain and desirable stirring. The apparatus includes a fluid tank for accommodating fluid therein, and at least one agitating device situated in the tank. The tank includes a bottom having a slope to allow the fluid to flow from one side of the bottom to the other side thereof, and a plurality of discharge ports disposed near the other side of the bottom. The agitating device includes a rotation axis suspended from an upper portion of the tank, a set of stirring blades attached to a lower part of the rotation axis and extending radially outwardly from the rotation axis, and a rotating device engaging the rotation axis. When the rotating device is actuated, the stirring blades can stir the fluid in the tank.

9 Claims, 6 Drawing Sheets

METHOD AND APPARATUS FOR STIRRING FLUID

BACKGROUND OF THE INVENTION AND RELATED ART STATEMENT

The present invention relates to an apparatus for stirring fluid, and more particularly, to an apparatus which can efficiently stir fluid in a tank, and a method for stirring fluid.

Conventionally, in case fluid, such as sludge, is introduced into a tank and is separated for treatment, an accelerating agent for separating fluid is added to the sludge while stirring blades disposed in the tank are agitating the sludge.

This apparatus includes a single tank. Thus, in case of processing high density fluid, if a setting angle for each stirring blade is large, a pressure resistance becomes high at rotation of the blades, so that a large amount of driving load is applied to a motor. Therefore, instead of forming the large setting angle for the blades, the stirring blades are rotated at a relatively high speed so as stir the high density fluid.

This prior apparatus has, however, following problems. Firstly, this apparatus is not suitable for a separation of the sludge, slurry or the like, a large amount of which is supplied, because it takes time for processing. Secondly, if a rectangular tank is used in this apparatus, turning flow is difficult to reach to the corner portions, especially to the corner portions at a bottom, because of the square corner portions. As a result, fluid at the corner is left unprocessed and a result from the process in a tank is undesirable. Therefore, in this prior apparatus, only a cylindrical tank can be used because the turning flow in such a cylindrical tank is satisfactory.

In order to obviate the foregoing problems, the object of the present invention is to provide an apparatus and a method for stirring fluid, wherein a large amount of fluid can be processed in a short period of time, and fluid can be stirred desirably and certainly even in a rectangular tank.

Further objects and advantages of the invention will be apparent from the following description of the invention.

SUMMARY OF THE INVENTION

In achieving the above-mentioned object, the present invention provides a structure in which an apparatus for stirring fluid has a fluid tank with a predetermined depth and a plurality of agitating devices disposed in the fluid tank. The fluid tank has a tilted tank bottom enabling fluid to flow from one side to other side of the tank bottom, and fluid discharge ports provided at the downstream of the fluid flow in the tank. A plurality of agitating devices is disposed parallel to each other from the one side to the other side in the tank. Each agitating device is formed of a rotation axis suspended from the upper portion of the tank, a plurality of stirring blades radially attached to the lower side of the rotation axis, and a rotating device engaging the rotation axis.

According to the present invention, an apparatus with a single agitating device may be also used.

Furthermore, each stirring blade for the agitating device can be provided to have a tilting angle such that a front rim of the stirring blade is low and a rear rim is high in a rotating direction of the stirring blade. Also, the stirring blades can be attached to be movable in an axial direction of the rotation axis.

According to the present invention, two or more sets of stirring blades can be provided in the axial direction of rotation axis.

In an apparatus for stirring fluid formed of a fluid tank with the predetermined depth and agitating devices disposed in the fluid tank, the present invention provides a method for stirring fluid, in which fluid in the fluid tank is agitated while the fluid is lifted from a bottom to an upper layer of the fluid by means of the stirring blades of the agitating devices situated in the lower portion of the fluid tank.

The present invention as stated above has the following operation.

When a predetermined amount of fluid is introduced into the fluid tank, and the stirring blades of the agitating device are actuated by the rotating device, since the stirring blades are continuously rotated in one direction in the center of the rotating axis, the fluid in the fluid tank is agitated while it is lifted from the bottom to the upper portion by the tilted blades.

Also, the bottom in the fluid tank is tilted, which causes fluid to flow from the one side to the other side in the tank, and the agitating devices are disposed parallel to each other in a direction of fluid flow, so that precipitating fluid gradually moves from the upstream of the fluid tank to the downstream to be discharged from the fluid discharge ports at the lowest part in the fluid tank.

If two sets of stirring blades are attached to the rotation axis, even if the fluid tank is deep, it can stir fluid efficiently.

DETAILED DESCRIPTION OF PREFERRED EMBODIMENTS

An embodiment of an apparatus for stirring fluid and a method for stirring fluid according to the present invention are explained with references to drawings herewith.

In FIGS. 1, 2, 5 and 6, stirring fluid apparatuses A, A', A" are used for separating sludge in excavated river, city river, lake, pond, canal or the like, and are also used for separating mud, and mixed fluid of organic and inorganic substances, which are obtained in collecting soil and sand. Each of the stirring fluid apparatuses A, A', A" is formed of a fluid tank 1, 1' or 1" and an agitating device 2 and/or 2' disposed in the fluid tank 1, 1' or 1".

Figure 1:
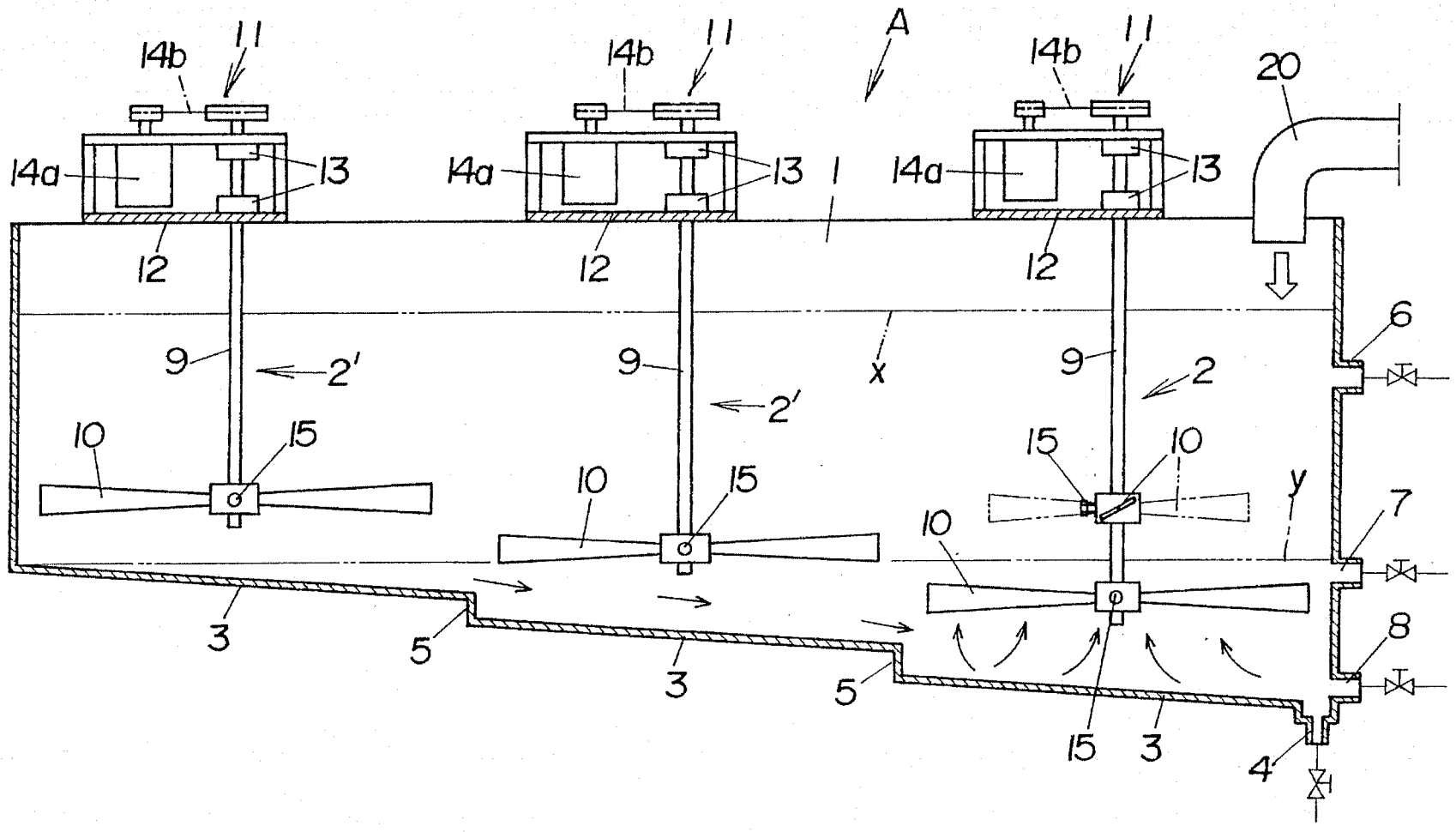
FIG. 1 shows a longitudinal section view of an embodiment with three-unit type tank for stirring fluid, which performs a method according to the present invention.
Figure 2:
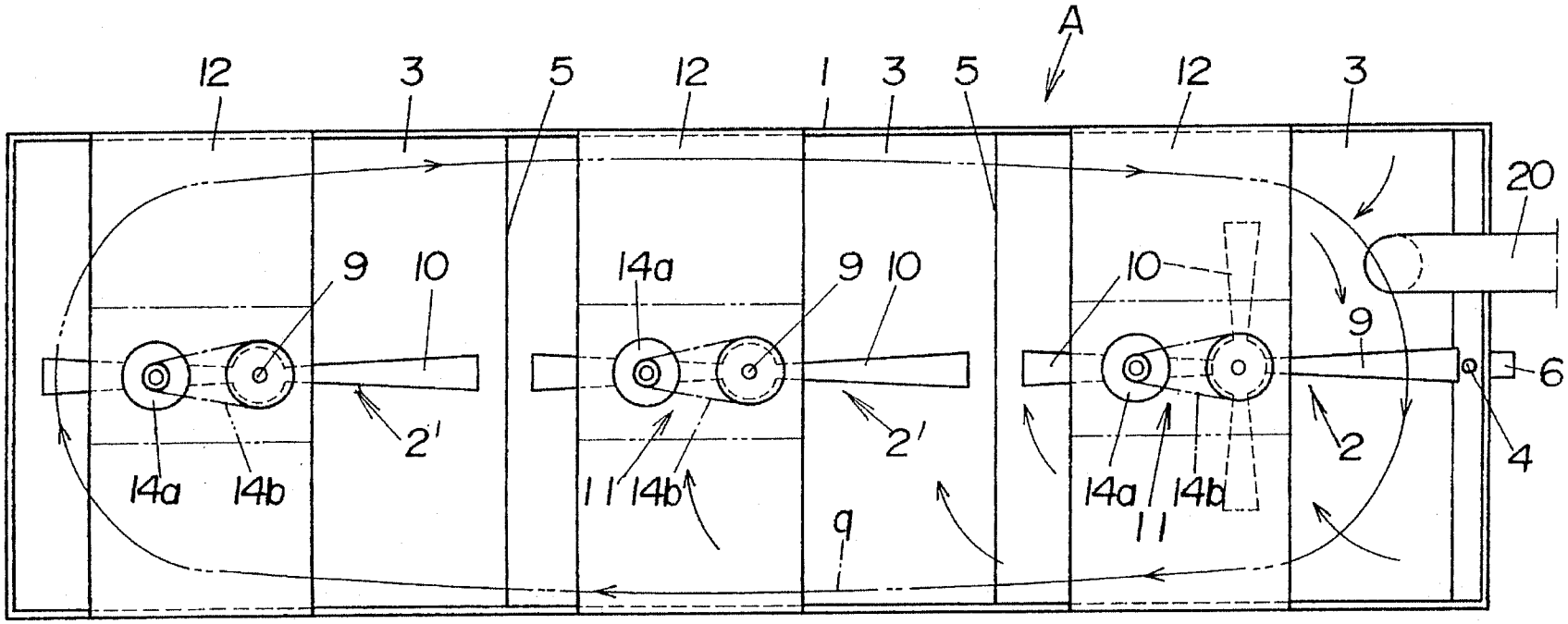
FIG. 2 shows a top plan view of the embodiment as shown in FIG. 1.
Figure 3:
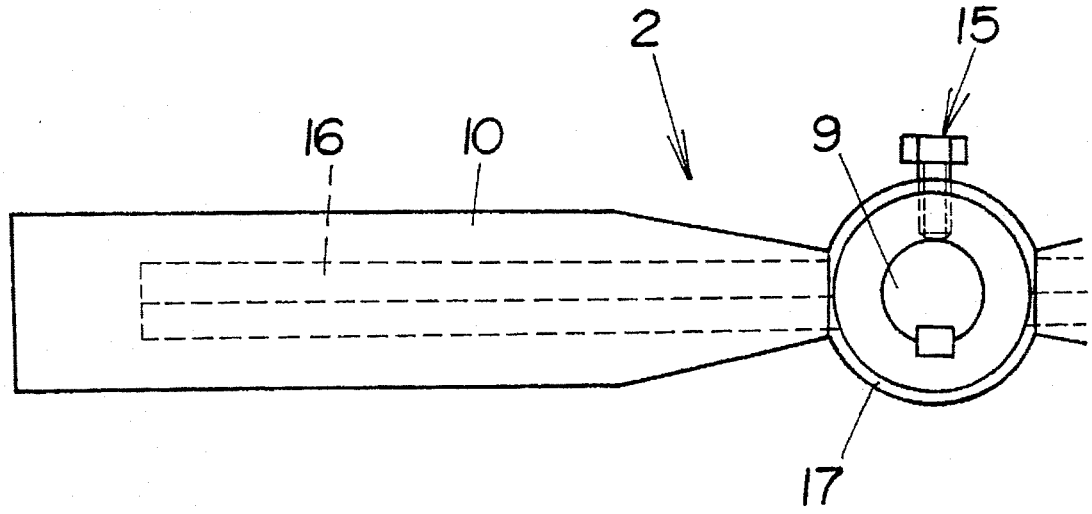
FIG. 3 shows an enlarged plan view of a main part of an agitating device as shown in FIG. 1.
Figure 5:
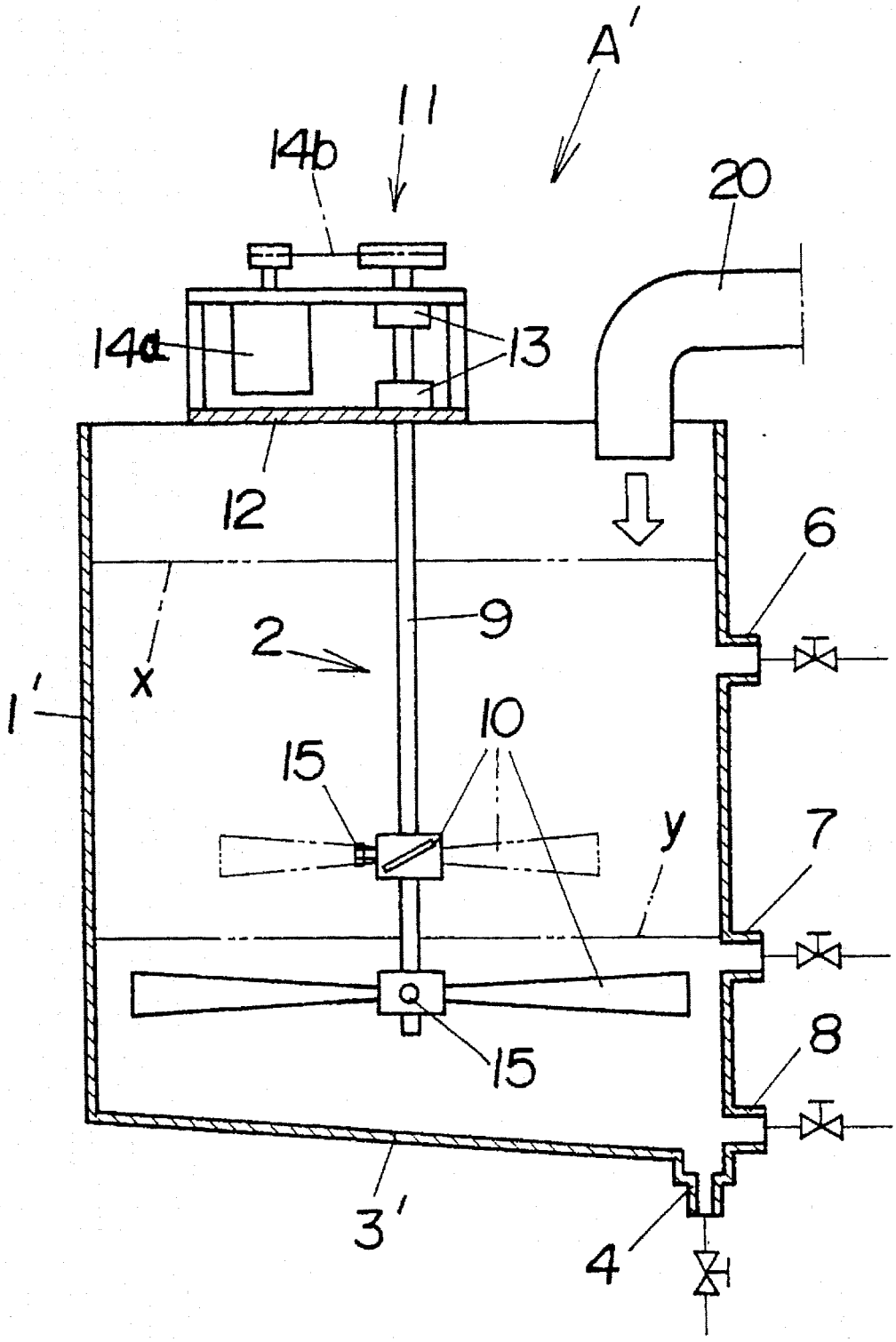
FIG. 5 shows a longitudinal section view of an embodiment with a single type tank shown in FIG. 1.

The fluid tanks 1, 1', 1" are formed to have any shapes in plan view thereof, such as square, circular, or ellipse. In the embodiments as shown in FIGS. 1, 2 and 5, fluid in the tanks flows from one side to the other side. Namely, the tanks 1, 1' include tank bottoms 3, 3' inclining from an upstream side at a high portion to a downstream side at a lower portion, and a fluid discharge port 4 disposed at the downstream side of the tank bottoms 3, 3'.

Figure 6:
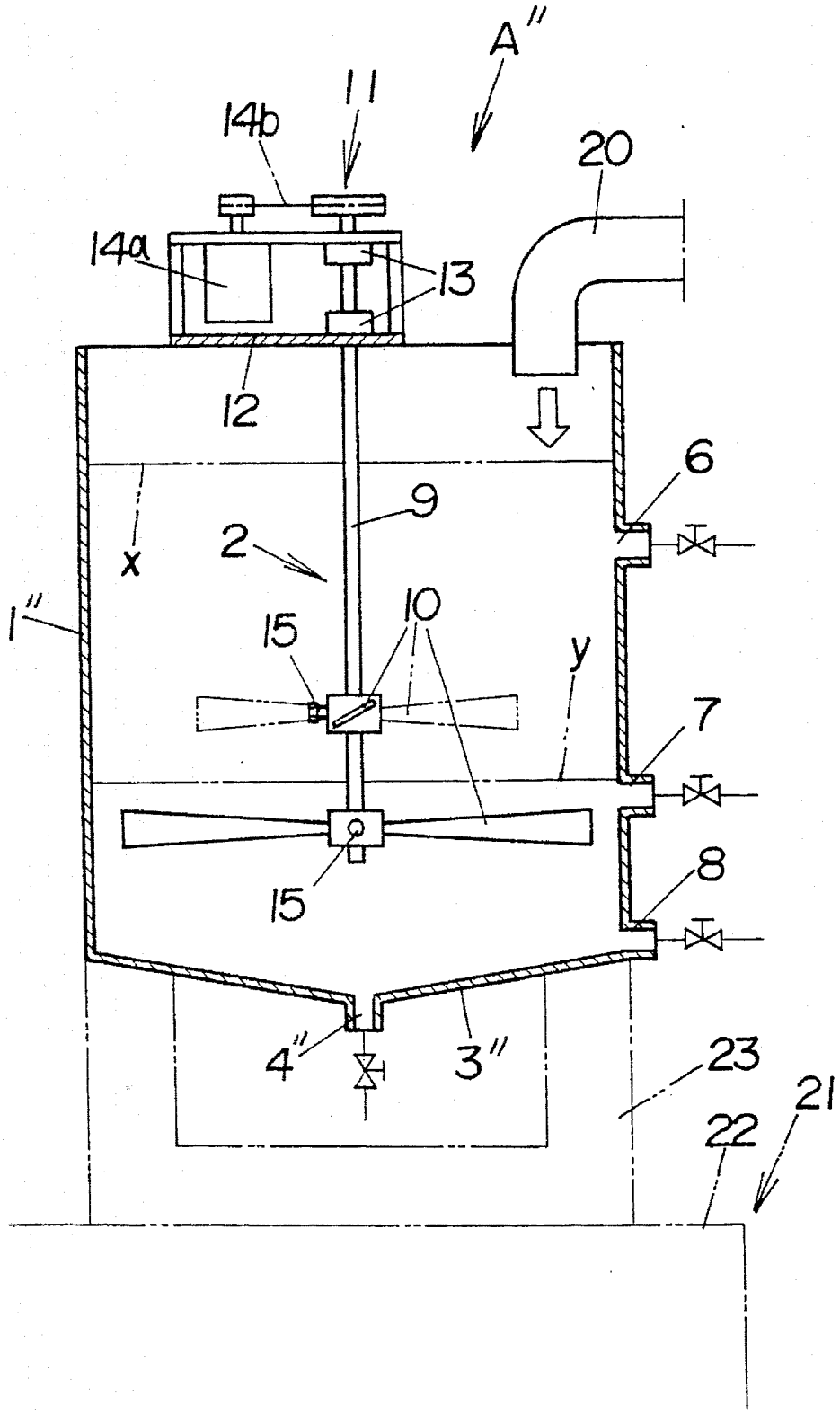
FIG. 6 shows a section view of the apparatus according to the present invention loaded on a vehicle.

In the embodiment as described in FIG. 6, the tank bottom 3" slopes down from the upstream side around a wall of the tank 1" to the downstream side at the center of the tank 1". A fluid discharge port 4" is disposed at the center of the tank 1" i.e. at the downstream side.

The sloping tank bottoms 3, 3' are desirable to have 1/15 to 1/25 gradient. In the embodiment as shown in FIG. 1 of the invention, three tank bottoms 3 are formed, and a predetermined size of gap 5 is respectively defined in a connecting portion between the tank bottoms 3 so as to have fluid flow step by step. Although the fluid tank 1 defines a continuous tank as a whole, each of the aforesaid tank bottoms 3 can define each individual tank.

The tank bottom 3 in the fluid tank 1 is not limited to a three-tier system as described. The fluid tank 1 can have more or less than three bottoms, or even have a single tank bottom as described in FIG. 5.

Furthermore, on a side wall of each fluid tank 1, 1' at the downstream side, there is provided a plurality of discharge pipes, for example, three discharge pipes 6, 7, 8, respectively spaced apart for a predetermined height therebetween. The discharge pipes 6, 7, 8 are provided on a side wall of the fluid tank 1". The highest discharge pipe 6 discharges supernatant liquid, the middle discharge pipe 7 discharges unseparated fluid, and the lowest discharge pipe 8 discharges separated fluid.

The agitating device 2 and/or 2' is provided in the fluid tank 1, 1' or 1" to stir the fluid in a predetermined way. In the embodiment shown in FIG. 1, the agitating devices 2, 2' are disposed parallel to each other from the one side to the other side in the fluid tank, i.e. from the upstream to the downstream. In the embodiment shown in FIG. 5, a single agitating device 2 is disposed.

Each of the agitating devices 2, 2' is constructed of a rotation axis 9 suspended from the upper portion of the fluid tank 1, 1' or 1" a plurality of stirring blades attached radially to the lower end portion of the rotation axis 9, and a rotating device 11 engaged with the rotation axis 9.

The rotation axis 9 is movably and perpendicularly supported by a bearing 13 attached to a fitting member 12 at the top of the fluid tank 1, 1' or 1". The upper end portion of the rotation axis 9 is connected to the rotating device 11 which is formed of a motor 14*a*, and a relating member 14*b*, such as a pulley or belt. The rotation axis 9 is activated to rotate at 10–60 rpm, preferably at 30 rpm.

This relatively slow rotation corresponds to the large setting angle of the stirring blades 10 described later, so that a surface of the blade does not receive strong fluid pressure. Further, the slow rotation can make the flow in the tank 1, 1' or 1" in a large movement so as to stir fluid thoroughly.

The stirring blades 10 are formed of two blades made from metal or the like, and attached to the rotation axis 9 fixedly or movably with use of adjustment means 15. At a reverse side of the stirring blade 10, a reinforcing rib 16 having a triangular shape or the like, which does not receive rotation resistance too much, is welded.

Figure 4:
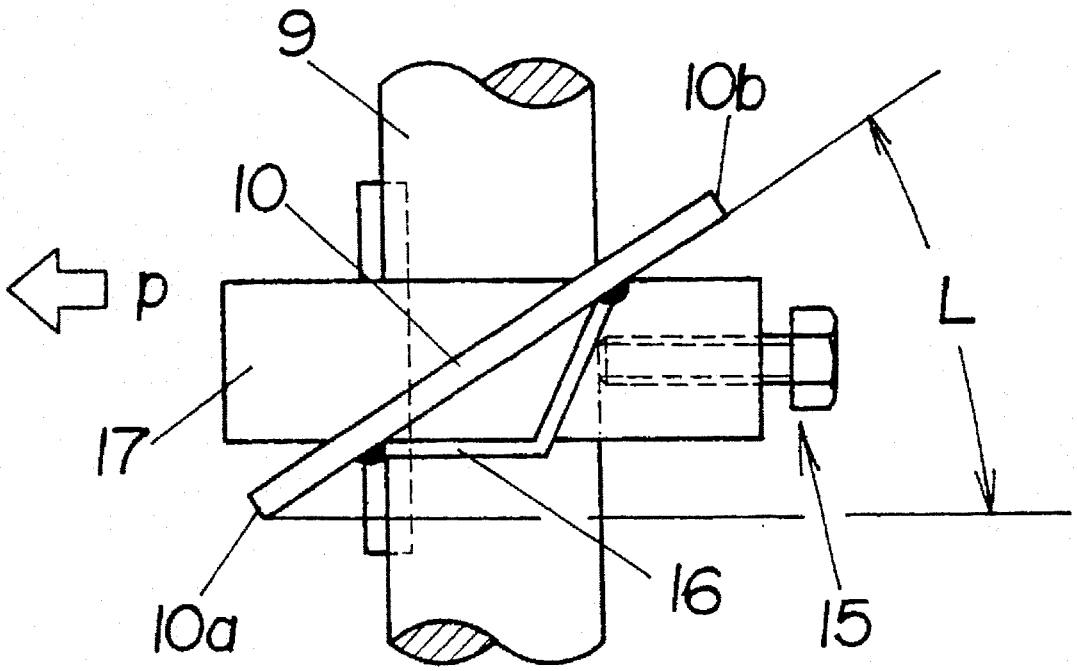
FIG. 4 shows a front view of the main part of the agitating device as shown in FIG. 3.

A base of the stirring blade 10 is welded around a periphery of a fitting ring 17 with a predetermined angle L, for example, 20 to 40 degrees, so that a front rim 10*a* of the blade 10 is lower than a rear rim 10*b* in a rotation direction shown by an arrow p in FIG. 4. The stirring blades 10 are located relatively near the tank bottom 3, 3' or 3" so that lower fluid is pushed upward from the bottom by the stirring blades 10.

In case the agitating devices 2, 2' are formed in three units as shown in FIG. 1, the stirring blades 10 are attached to the rotation axis 9 such that the stirring blades 10 are gradually lowered down from the upstream to the downstream. Although in this embodiment, the stirring blades 10 are spaced equally to the tank bottom 3, the attaching positions of the blades 10 relative to the tank bottom 3 may be different.

Further, in the agitating device 2 disposed at the lowest flow in the fluid tank 1 as shown in FIG. 1 or tank 1' or 1" as shown in FIGS. 5 and 6, plural sets of stirring blades 10, for example two sets of stirring blades 10, can be provided to have a predetermined space away from each other in an axial direction of the rotation axis 9. The upper and lower sets of stirring blades 10 are disposed differently about 90 degrees, and interlockingly rotate by rotation of the rotation axis 9. The size of the stirring blades 10 at the upper set is formed in about one-third less than that of the lower set, and the angle L at the upper set is set at about 0 to 10 degrees larger than the setting angle of the blades 10 at the lower set.

These two sets of the stirring blades 10 improve stirring of the fluid when the fluid tank 1, 1' or 1" is formed deeply. The fluid pushed upwardly by the lower set of the blades 10 from the tank bottom 3, 3' or 3" is further urged by the upper set of the blades 10 toward the top of the fluid tank 1, 1' or 1" so that the effect of stirring the fluid becomes more desirably. Besides, since the blades 10 at the upper set are attached with setting angle greater than that of the blade 10 at the lower set, the upper set of the blades can push the fluid stronger than the lower set of blades so as to cause the negative pressure between the upper set of the blades and the lower set of the blades. Therefore, fluid is accelerated to flow into a space between the upper set of the blades 10 and the lower set of the blades 10, so that the fluid flow at the tank bottom 3, 3' or 3" or at the corner portions of the fluid tank 1, 1' or 1" is further activated.

The apparatus A of the present invention having aforementioned structure is explained when used for separating a sludge mixed in water by adding chemicals as a separation accelerating agent.

As shown in FIG. 1, fluid, such as sludge, is supplied into the fluid tank 1 up to a first base line x by means of a supply pipe 20 disposed on a top of the fluid tank 1. Then, the stirring blades 10 of the agitating devices 2, 2' are activated by the rotating devices 11.

Consequently, since the stirring blades 10 continuously rotate on the rotation axis 9 in one direction, the fluid in the tank 1 is stirred and urged upward by the blades 10 from the tank bottom 3 to the upper part of the tank as shown in FIGS. 1 and 2.

The fluid flow pushed or urged upwardly can completely move stagnated fluid at the corner portions of a square tank to thereby stir and mix the fluid and chemicals thoroughly.

The heavy part of the sludge separated from water by adding the chemicals is precipitated to form a layer and flows from one side of the tank bottom 3 to the other, i.e. from the upstream side to the downstream side according to the slope of the bottom. The heavy part of the sludge is precipitated or accumulates up to a second base line y on the tank bottom 3.

The precipitation is gradually discharged from the discharge port 4 or the discharge pipe 8 disposed in the fluid tank 1, and supernatant liquid at the upper side in the tank is gradually discharged from the highest discharge pipe 6 disposed in the tank 1. The supernatant liquid flows in a big movement as shown by an arrow q in FIG. 2 so as to separate the fluid thoroughly and equally.

As described above, after the fluid is supplied into the fluid tank 1, the fluid can be separated into the heavy part of sludge and the supernatant liquid in 15 minutes, and the desirable treating can be made.

In FIG. 6, 21 designates a freight car, such as a truck, having predetermined load capacity, and the apparatus A" according to the present invention is mounted on a bed 22 attached by use of an attachment member 23. Therefore, the apparatus A" can be moved to a location in which treatment of the fluid is needed, and the predetermined processing can be made at the location.

As described above, in the apparatus and method for stirring fluid according to the present invention, since the fluid can be stirred satisfactorily, treatment of the fluid can be done in a short time. Thus, the sludge supplied in a large amount can be separated satisfactorily.

Further, even if the square fluid tank is used in the invention, the turning flow and the upward flow occur at the corner portions of the tank. Thus, unprocessed fluid is not left at the corner portions, and the desirable fluid treatment can be done. Therefore, the apparatus having the square tank can be expected to have turning flow or the like as in the apparatus having the cylindrical tank.

While the invention has been explained with reference to the specific embodiments of the invention, the explanation is illustrative and the invention is limited only by the appended claims.

What is claimed is:

1. An apparatus for stirring fluid, comprising:

a tank for accommodating fluid including an upper portion, a bottom having a slope to allow the fluid to flow from one side of the bottom to the other side thereof, and a plurality of discharge ports disposed near said the other side of the bottom; and at least one agitating device situated in the tank, said agitating device including a rotation axis suspended from the upper portion of the tank, a first set of stirring blades attached to a lower part of the rotation axis, said blades extending radially outwardly from the rotation axis, and a rotating device engaging the rotation axis so that when the rotating device is actuated, the stirring blades can stir the fluid in the tank.

2. An apparatus for stirring fluid according to claim 1, wherein each stirring blade includes a front rim and a rear rim relative to a rotating direction of the blade, each stirring blade being attached to the rotation axis to have an angle so that the front rim is lower than the rear rim in said rotating direction.

3. An apparatus for stirring fluid according to claim 2, wherein said stirring blades are axially movably attached to the rotation axis.

4. An apparatus for stirring fluid according to claim 2, wherein said agitating device further includes an additional set of stirring blades attached to the rotation axis upwardly away from said first set of the stirring blades, said stirring blades of the additional set extending radially outwardly from the rotation axis to improve stirring of the fluid.

5. An apparatus for stirring fluid according to claim 4, wherein said angle of the blade of the first set is less than that of the additional set so that the fluid on the bottom of the tank is forcibly urged upwardly.

6. An apparatus for stirring fluid according to claim 5, wherein said blades of the first set is angularly differently disposed relative to the blades of the additional set.

7. An apparatus for stirring fluid according to claim 1, wherein a plurality of agitating devices is situated in the tank and arranged from the one side to said the other side parallel to each other.

8. An apparatus for stirring fluid according to claim 1, wherein said fluid contains solid materials, said solid materials accumulating on the bottom of the tank and flowing from said one side to said the other side.

9. A method for stirring fluid in a fluid stirring apparatus, comprising:

providing a tank having a bottom, and at least one agitating device situated in the tank and having a first set of stirring blades disposed near the bottom of the tank and an additional set of stirring blades situated above and away from the stirring blades of the first set, each of said stirring blades including a front rim and a rear rim relative to a rotating direction of the blade and being attached to a rotation axis to have an angle so that the front rim is lower than the rear rim in said rotating direction; and rotating the stirring blades in the tank in a direction such that the fluid in the tank can be urged upwardly from the bottom of the tank to an upper side of the tank and stirred simultaneously, said angle of the stirring blade of the first set being less than that of the additional set so that the fluid on the bottom of the tank is forcibly urged upwardly.

* * * * *